US005351758A

United States Patent [19]

Henderson et al.

[11] Patent Number: 5,351,758

[45] Date of Patent: Oct. 4, 1994

[54] TUBING AND PROFILE REAMING TOOL

[75] Inventors: Michael Henderson; Dale O. Tupper, both of Singapore, Singapore

[73] Assignee: Pacific Well Services Ltd., Tortola, British Virgin Isls.

[21] Appl. No.: 20,638

[22] Filed: Feb. 22, 1993

[51] Int. Cl.[5] ..... E21B 37/00

[52] U.S. Cl. ..... 166/277; 166/174; 166/311; 175/279; 175/289

[58] Field of Search ..... 166/277, 304, 311, 173, 166/174, 170, 902; 175/269, 279, 289, 291

[56] References Cited

U.S. PATENT DOCUMENTS

| | | | |
|---|---|---|---|
| 2,719,699 | 10/1955 | Baker | 255/75 |
| 3,220,478 | 11/1965 | Kinzbach | 166/55.8 |
| 3,251,418 | 5/1966 | Condra | 166/173 |
| 3,684,009 | 8/1972 | Murray | 166/55.8 |
| 4,291,764 | 9/1981 | Pampell | 166/173 |
| 4,893,675 | 1/1990 | Skipper | 166/55.8 |
| 5,014,780 | 5/1991 | Skipper | 166/55.8 |
| 5,018,580 | 5/1991 | Skipper | 166/298 |

*Primary Examiner*—Terry Lee Melius
*Attorney, Agent, or Firm*—James L. Jackson

[57] ABSTRACT

A method and apparatus for reaming foreign deposits from the flow passage of well production tubing and cleaning deposits from the completion profiles within the tubing as well as for drifting the production tubing while located within a well bore. A reaming tool is extended through the tubing string and is rotated for reaming operations. A plurality of reaming dogs of the tool are selectively and radially expanded to tubing and tubing completion profile reaming positions by cams of a hydraulically operated linearly removable actuator mandrel. The actuator mandrel is spring-urged toward a position permitting spring-urged retraction of the reaming dogs so that the reaming tool may be introduced into or withdrawn from the tubing string by linear movement. The actuator mandrel has cams thereon for accomplishing radial expansion of the reaming dogs and defines a restricted through-passage to permit the flow of fluid for other downhole activities or to permit fluid circulation through the tubing with the reamer located therein.

19 Claims, 2 Drawing Sheets

TUBING AND PROFILE REAMING TOOL

FIELD OF THE INVENTION

This invention relates generally to tools for reaming foreign matter, such as pipe scale build-up, mineral deposits such as sulfates, etc., that become deposited within the production tubing of wells, especially under conditions of high temperature production activities. More particularly, the present invention relates to a tubing and profile reaming tool that can be readily adapted for cleaning deposits of foreign matter from the inside surfaces of well production tubing and reaming of such foreign matter from internal profiles such as completion profiles that are typically present within a well tubing string. Even further, the present invention concerns a reaming tool for well tubing incorporating expandable and retractable reaming dogs that permit the tool to readily traverse the tubing string with the reaming dogs retracted and then, with increase of hydraulic pressure, expand the reaming dogs to the reaming positions thereof.

BACKGROUND OF THE INVENTION

When wells are drilled for production of petroleum products, well casing is inserted into the well bore and cemented in place to provide a durable, pressure containing lining for the well bore. For production of the petroleum products, such as crude oil, natural gas, and various mixtures thereof with other liquid such as water, one or more tubing strings are positioned within the well casing, typically being supported by a wellhead assembly. These tubing strings are sealed with respect to the wellhead such as by the connecting assemblies thereof and are also sealed downhole with respect to the casing by means of packers. Typically, through the use of packers, production zones for petroleum products are isolated in the well casing and the lower end of the tubing string is open to the production zone so that the petroleum products, flowing from the production zone into the well casing via perforations, may be conducted to the surface for production at the wellhead. Valve controlled flowlines extend from the wellhead to receiving lines for the petroleum products, often being passed through separators and other preliminary processing equipment for separating gases from liquids, for removing sand and other foreign matter contained in the well fluids, and perhaps also separating water and natural gas from the crude oil. If two or more production tubing strings are suspended within a well casing, typically these production strings terminate at different depths within the well bore and produce petroleum products from different production zones.

In order to facilitate selective downhole location of various well tools and to provide for location of completion equipment within a production tubing string, the tubing string is typically provided with internal completion profiles. These completion profiles are typically defined by tubing sections known as landing nipples or completion nipples. The corresponding well tool incorporates a section having a latch mechanism that is capable of entering the enlargements defined by the completion profiles and thus establishing a properly located and locked condition with respect to the tubing string. The latch mechanisms of well tools may be operated in any number of ways including mechanically, hydraulically, pneumatically, electrically, etc. The locking mechanism of the well tool is typically established at a set position at the time it enters the tubing string. After traversing the tubing string to an approximate depth, the latch mechanism is selectively actuated so that its latches expand into forcible engagement with the inside wall surface of the tubing string. Thereafter, the well tool is moved downwardly or upwardly to bring the latch mechanism into registry with the internal landing profile of the tubing string. When such registry has been established, the latch mechanism will then expand to its latched position and thus secure the well tool in a locked condition within the production string so that it can accomplish its desired purposes. Any number of different types of well tools such as well completion apparatus and well service tools, may be operatively positioned with respect to the tubing string in this manner. The well tools are capable of being removed from the tubing string by controllably actuating the latch mechanism to its unlatched position so that the well tool can be withdrawn through the tubing string by means of wireline equipment, by a coil tubing string, macaroni tubing string, etc.

Oil and gas fields in various portions of the earth's surface can have production conditions that facilitate fairly rapid build-up of foreign matter. For example, scale build-up within the production tubing has been common in the harsh well conditions of the gas fields that are located in the gulf of Thailand. This scale build-up must be periodically cleaned from the inside surface of the production tubing because it otherwise diminishes the flow capacity of the tubing and interferes with movement of well service and production tools through the tubing string.

Under severe conditions and high temperatures, production fluid contained materials such as barium sulfate, strontium sulphate and the like can become baked onto the inside of the production string such that the inside dimension of the production tubing is significantly reduced. These mineral deposits can become very hard and can be difficult to remove. For example, it is common for barium sulphate and strontium sulphate deposits to build up inside the tubing string and completion profiles to such an extent that total inside diameters of the production tubing are sometimes reduced by up to 25%, making most types of through tubing well servicing operations almost impossible. During such foreign matter build-up, the deposits of foreign matter also buildup inside the landing or completion profiles to such an extent that various well tools are not able to become properly seated and latched. Under this circumstance, it is desirable to provide a mechanism for not only cleaning the inside surface of the production tubing of undesirable production fluid mineral deposits and scale, but also cleaning such deposits from the completion profiles of the production tubing as well. It is also desirable that the reaming tool have the capability of cleaning the completion profiles of the production tubing without in any way distorting the critical configuration of the completion profiles. It is even further desirable to provide a cleaning tool for production tubing that is capable of sensing the location of a completion profile and cleaning it of any production fluid deposits so that it is returned to desired profile specifications for continued use.

When production tubing is installed within a well, especially where the tubing is deviated from the vertical to any extent, the inside dimension of the production tubing may not be to drift specifications. Thus it may be difficult or impossible to run well tools through the tubing string. It may be desirable to run a drift reamer through the production tubing while the reamer is being rotated, such as by means of a tubing supported downhole motor, to remove internal metal and slightly expand any tight spots in the production tubing to a minimum manufacturer's specification so that completion tools and well service tools may be efficiently passed through the production tubing without the possibility of "hanging up". This process is known in the industry as "drifting" the tubing. It is desirable, therefore, to provide a reaming tool for downhole production tubing which has the capability of accomplishing tubing drifting operations in addition to conducting other tubing cleaning operations as selected by the user.

SUMMARY OF THE INVENTION

It is a principal feature of the present invention to provide a novel cleaning tool for production tubing which has the capability of cleaning undesirable deposits from the inside wall surface of the tubing string and from the completion profiles that are located within the tubing string.

It is also a feature of the present invention to provide a novel tubing service tool having the capability of cleaning mineral deposits and other foreign matter from the completion profiles of the tubing string without in any way altering the configuration of the completion profile or increasing its dimension.

It is an even further feature of the present invention to provide a novel tubing and completion profile reaming tool that is capable of being run into the tubing string such as by means of coiled tubing or macaroni tubing or by rotating by a downhole motor or other rotary drive mechanism to accomplish cleaning of deposits from the internal wall surfaces and completion profiles of a production tubing string.

It is an even further feature of the present invention to provide a novel tubing and profile reaming tool that is capable of being expanded and retracted to and from tubing reaming condition by means of hydraulic pressure established by flowing well service fluid.

It is another feature of this invention to provide a novel tubing and profile reaming tool that defines a flow passage therethrough through which well servicing fluid is enabled to flow for the purpose of conducting other downhole tubing string activities simultaneously with conducting a reaming operation.

Briefly, the various features of the present invention are realized through the provision of a tubing and profile reaming tool having a generally cylindrical housing structure that is enabled at its upper end for threaded connection to a downhole motor, to a well service string or to any other suitable well servicing tool of differing character. The housing structure is defined by upper and lower intermediate housing sections or "subs". Within the housing structure are located a plurality of reaming dogs that are supported for lateral movement within the housing to a collapsed or retracted position where the dogs are retracted to positions within the housing structure. The reaming dogs are also an extended position where the dogs are expanded for reaming contact with the inner wall surface of the tubing or for expansion into detected completion profiles of the tubing. For reaming operations, the housing structure is capable of being rotated by a downhole motor such as can be supported within the production string by coiled tubing or any rotary unit capable of rotating small through-tubing work strings.

For actuating the reaming dogs between the retracted and expanded positions thereof, within the housing is located an elongate actuator mandrel having external cams thereon which react with internal cam surfaces defined by the reaming dogs to translate linear motion of the elongate actuating mandrel into lateral or radial motion of the reaming dogs. The elongate mandrel defines a passage therethrough through which well service fluid may flow and also defines an internal restriction. The restriction may be defined by the passage itself or a restriction such as a "choke bean" may be secured to the mandrel in positions for reducing the effective dimension of the flow passage. The mandrel is hydraulically energized by fluid pressure that enters the housing through the service string, and develops a resultant force acting downwardly on the mandrel. The resultant force developed by the hydraulic pressure is responsive to both the pressure level and the characteristics of the restriction. This resultant force can be altered by replacing an interchangeable orifice or by providing a mandrel having an internal flow passage of differing dimension.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

Figure 1:
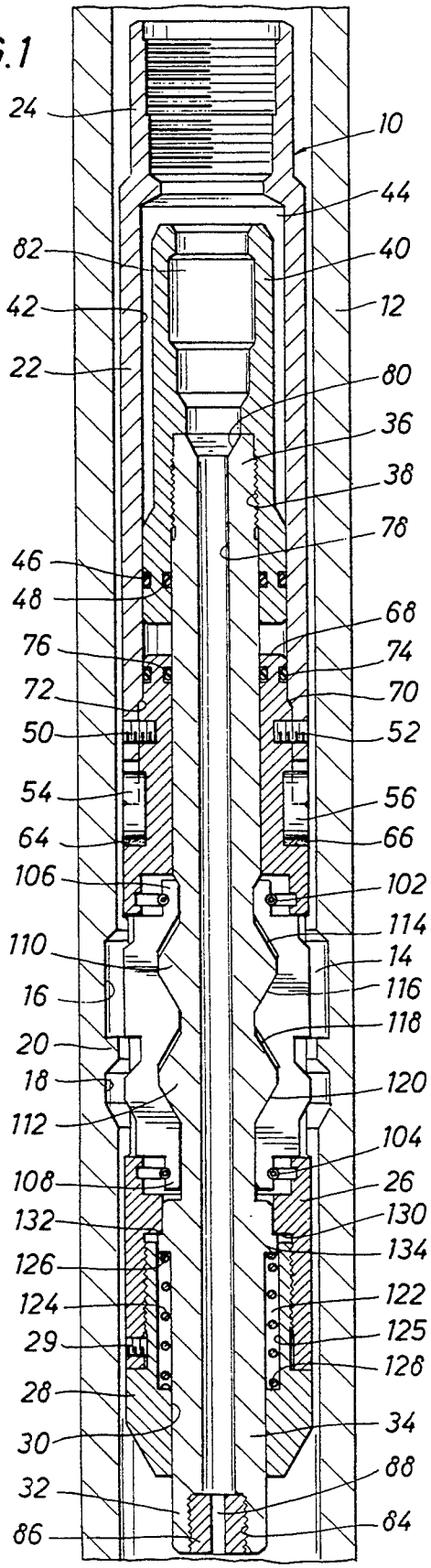

FIG. 1 a sectional view illustrating a tubing and completion profile reaming tool that is constructed in accordance with the present invention and is shown to be located inside a production tubing string with its reaming dogs shown collapsed or retracted but in registry with the completion profile of the tubing string.

Figure 2:
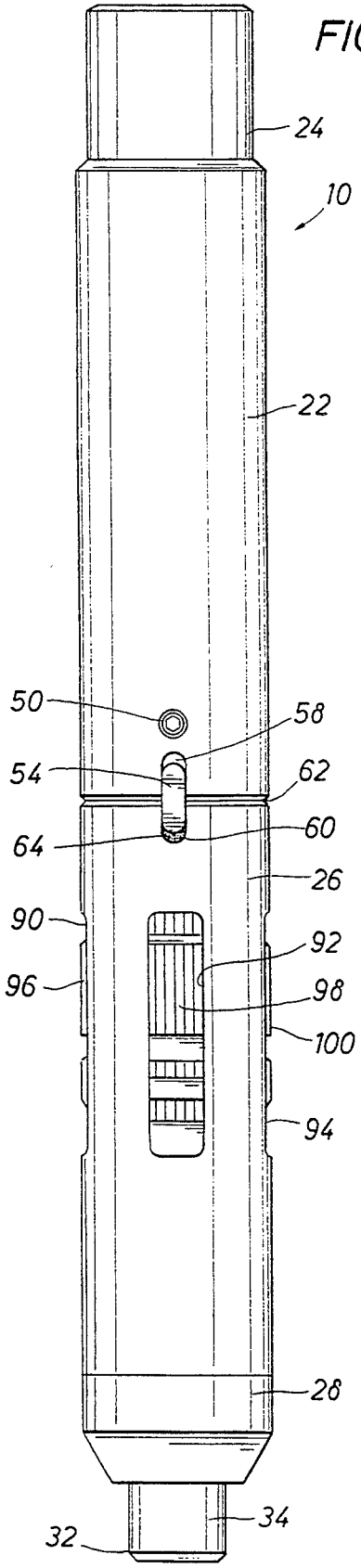

FIG. 2 is an elevational view of the tubing and profile reaming tool of FIG. 1 with the reaming dogs thereof shown in their collapsed positions.

Figure 3:
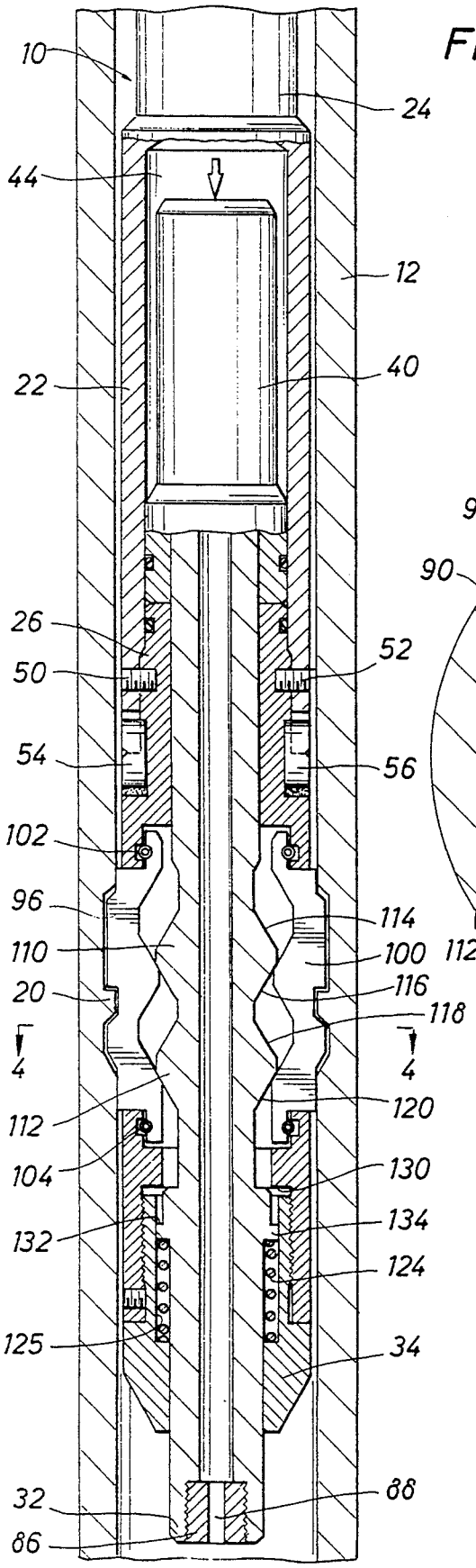

FIG. 3 a sectional view similar to that of FIG. 1 and illustrating the reaming dogs of the tubing and profile reaming tool being expanded to the maximum extent thereof for reaming the completion profile of the tubing string.

Figure 4:
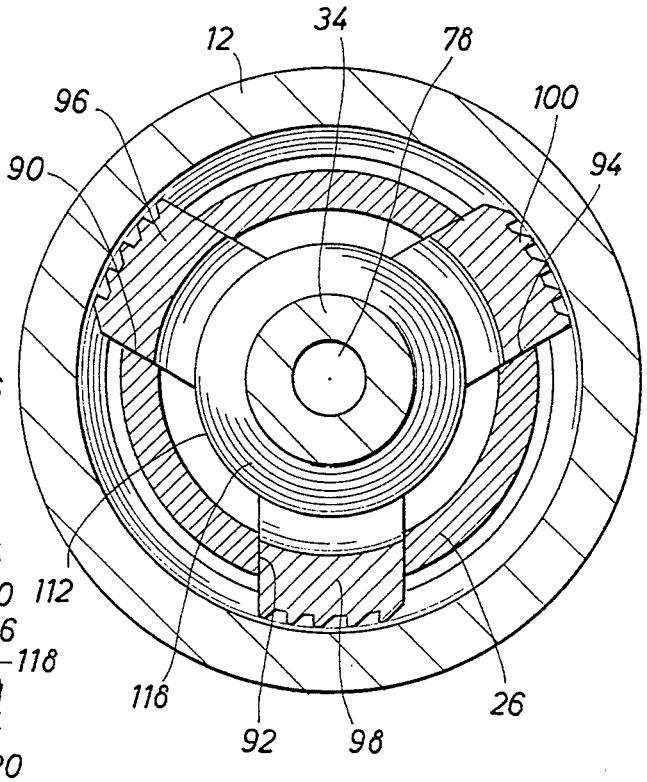

FIG 4 sectional view taken along line 4—4 of FIG. 3.

DETAILED DESCRIPTION OF PREFERRED EMBODIMENT

Referring now to the drawings and first to FIGS. 1 and 2 a tubing and profile reaming tool that is constructed in accordance with the present invention is illustrated generally at 10 and is shown in FIG. 1 to be located within a production tubing string 12 having defined therein a completion profile 14. The completion profile may be defined by a landing or completion nipple comprising a portion of the tubing string. For the purpose of simplicity, the completion profile is merely shown as internal upper and lower tubing string enlargements 16 and 18 having an internal flange 20 located therebetween.

The tubing and profile reaming tool 10 incorporates an upper housing sub 22 having an internally threaded upper connection 24 that is adapted to threadedly receive the lower threaded end of a downhole motor drive connector or any other device or mechanism that is capable of imparting rotation to the reaming tool 10. The tool incorporates an intermediate housing structure 26 having a lower housing sub 28 threadedly connected therein in the manner shown in FIG. 1. The lower sub 28 defines an internal opening 30 through which extends the lower portion 32 of an elongate actuator mandrel 34.

The actuator mandrel 34 is externally threaded at its upper end 36 and is disposed in threaded engagement with the internally threaded section 38 of a fishing neck 40. The fishing neck is sealed with respect to an internal cylindrical surface 42 of an internal tool chamber 44 by means of an external seal or seal assembly 46 which is appropriately retained within an annular seal recess. The seal 46 is typically a high pressure, heat resistant seal, but may be of any suitable character which is adaptable for the particular service within which the tool 10 is utilized. The fishing neck 40 is also sealed with respect to the actuator mandrel 34 by means of an internal sealing member or assembly 48.

The tipper sub 22 is maintained in assembly with the housing structure 26 by means of one or more shear elements such as shown at 50 and 52 which may conveniently take the form of allen screws which are threadedly received by corresponding openings in the upper sub and in the upper portion of the housing 26. It is intended that the shear elements 50 and 52 are capable of shearing only when predetermined upward linear force is applied to the upper sub 22 of the reaming tool and that the shear members be protected against shearing in response to rotary forces. Face-to-face contact of the subs 22 and 26 provides shear protection when downward force is applied to the tool. One suitable means for preventing relative rotation of the upper sub and housing is provided by opposed anti-rotation keys 54 and 56 which are received within registering elongate slots of the upper sub 22 and the housing 26. As shown in FIG. 2, upper and lower elongate slots 58 and 60, are defined respectively by the lower extremity of the upper sub and the upper extremity of the housing. The key members 54 and 56 are positionable so as to bridge the joint 62 between the upper sub and housing to thus interlock the upper sub and housing in non-rotatable relation. The keys 54 and 56 are secured in position relative to the housing 26 by means of weld metal as shown at 64 and 66 after the upper sub and housing have been brought into assembly. This feature permits the upper sub to be moved upwardly relative to the housing if for any reason the reamer tool mechanism should become temporarily locked into a tubing profile or otherwise stuck within the tubing. The shear screws 50 and 52 will become sheared upon linear movement of the upper sub from the housing 26 in response to application of predetermined upward force to the upper sub 22.

To protect the shear screws 50 and 52 against becoming sheared by application of downward force the upper end 68 of the housing and to provide for proper seating of the upper sub and the housing, the housing is provided with a tapered external stop shoulder 70 which is disposed for engagement with a corresponding tapered internal shoulder 72 of the upper sub 22. The upper end of the housing is sealed with respect to the upper sub 22 by means of an external circular seal assembly 74 and is sealed with respect to the actuator mandrel 34 by means of an internal seal assembly 76.

The actuator mandrel 34 defines an elongate, straight-through flow passage 78 through which fluid is permitted to flow for the conduct of other downhole well servicing operations. The passage 78 permits other servicing activities to be conducted simultaneously with location of the reaming tool within the tubing string. The passage 78 is provided with a tapered upper surface 80 which insures efficiency of transitioning flow into the passage from the large dimensioned opening 82 that is defined by the upper portion of the fishing neck 40. The passage 78 is of significantly smaller dimension as compared to the fishing neck cavity 82 and thus cooperates with the internal surfaces of the fishing neck to define a pressure responsive surface. Thus as pressure is increased within the internal chamber 44 there is developed a corresponding increase in pressure-induced resultant force acting downwardly on the actuator mandrel 34. Consequently, the force tending to urge the actuator mandrel downwardly is responsive to the fluid pressure within the chamber 44 and to the effective dimension of the flow passage.

Although the dimension of the flow passage 78 can be considered a choke or restriction for pressure responsive control of the downward force on the actuator mandrel, the actuator mandrel may be provided with means for selecting the pressure to force ratio of the actuator mandrel. For example, as shown at the lower portion of FIG. 1 the actuator mandrel defines an internally threaded receptacle 84 which is of a greater diameter as compared to the flow passage 78. Within the receptacle 84 may be located an externally threaded choke bean 86 defining a restricted flow passage which controls the effective dimension of the flow passage. The choke bean is replaceable to thus permit the operator to select the ratio of the pressure responsive force that is applied to the actuator mandrel by pressure within the chamber 44. Thus, the force ratio can be changed simply by replacing the choke bean 86 with another choke bean having a larger or smaller choke passage as desired.

It is desirable to provide the reaming tool 10 with the capability of reaming mineral deposits and other foreign matter from the inside surface of the production tubing 12 and to also have the capability of removing deposits of material from the various completion profiles that are present within the production tubing. It is also desirable that the reaming tool have the capability of drifting the tubing string while it is located within the well. For this purpose the housing structure 26 defines a plurality of lateral openings or windows as shown at 90, 92 and 94, there preferably being three windows as shown in FIG. 4. It should be borne in mind however, that the housing structure of the reaming tool may be provided with one or more windows as is suitable for the intended purpose without departing from the spirit or scope of the present invention. A corresponding number of reaming dogs such as shown at 96, 98 and 100 are movably disposed within the housing 26 and are capable of being moved radially from a retracted position as shown in FIG. 1, to an extended position as shown in FIG. 3. At the retracted position scraper or reamer teeth that are defined by each of the reaming dogs are disposed out of contact with the inner surface of the tubing or the inner surface of the completion profile. In this position the reaming tool may be moved linearly through the tubing string while out of contact with the wall surfaces of the tubing. When fully extended or expanded as shown in FIG. 3 the teeth of the reaming dogs are positioned for scraping or reaming away virtually all of the deposits that might be present within the completion profiles without causing any enlargement or other distortion of the internal configuration of the profiles. The external configuration of the reaming dogs is designed for the particular completion profiles that are being cleaned of foreign deposits.

The reaming dogs are each urged toward the retracted positions thereof as shown in FIG. 1 by means of upper and lower garter springs 102 and 104 which are received respectively within annular spring grooves or recesses that are defined within the housing and externally of upper and lower reamer dog extensions such as shown at 106 and 108. The upper and lower garter springs are arranged to simultaneously urge each of the reaming dogs toward the retracted positions thereof.

It is desirable to provide for mechanical extension or expansion of the reamer dogs toward the fully extended positions thereof as shown in FIG. 3 upon increase of hydraulic pressure within the internal pressure chamber 44 of the reamer tool. To accomplish this feature the actuator mandrel 34 is provided with at least one and preferably a pair of external cams as shown at 110 and 112, each defining upper and lower tapered external cam surfaces. The upper cam defines an upwardly facing cam surface 114 and a downwardly facing cam surface 116 while the lower cam 112 defines an upwardly facing cam surface 118 and a downwardly facing cam surface 120. Each of the reaming dogs is provided with correspondingly configured tapered internal cam surfaces which have mating relation with respective external cam surfaces of the actuator mandrel. As the actuator mandrel 34 is urged downwardly by the pressure induced resultant force in response to increase in fluid pressure within the chamber 44, the downwardly facing cam surfaces 116 and 120 react against the corresponding upwardly facing cam surfaces of the reaming dogs thereby urging the reaming dogs to move radially outwardly or expand toward the fully expanded reaming position shown in FIG. 3 against the mechanical bias of the upper and lower garter springs 102 and 104. When the actuator mandrel 34 is moved upwardly by spring force as will be explained herein below or by any other suitable means the springs 102 and 104 will move the reaming dogs toward the respective retracted positions thereof as shown in FIG. 1.

It is desirable to impart upward movement to the actuator mandrel 34 when fluid pressure within the chamber 44 is reduced below a predetermined minimum. For this purpose the lower sub 34 defines an enlarged cavity 125 which cooperates with the external surface of the actuator mandrel to define an annulus or spring chamber 122 within which is received a compression spring 124. The respective ends of the compression spring bear against shoulders 126 and 128 which are defined respectively by the actuator mandrel and by the lower sub. The return spring 124 is capable of imparting sufficient spring force to the mandrel 34 so as to move it upwardly within the reamer housing under circumstances where hydraulically induced force acting downwardly on the mandrel is reduced to or below a predetermined minimum. To insure against upward over-travel of the mandrel within the housing a stop shoulder 130 is defined within the housing 26 and is located for engagement by an upwardly facing shoulder 132 defined by an enlargement 134 that is provided on the actuator mandrel.

OPERATION

The tubing and tubing profile reamer of the present invention is affixed to any suitable rotating device that is capable of being passed through the tubing string. For example, the reaming tool may be fixed to the operating shaft of a downhole motor which may be connected to coil tubing or it may be threadedly assembled to a coiled tubing string or a macaroni tubing string as desired. The reaming tool may also be run on snubbing units utilizing macaroni tubing, or drilling and workover units provided with any small through tubing work string. The reaming tool is introduced into the production tubing string and after being run to the desired depth, is caused to rotate for the purpose of reaming or drifting the internal wall surfaces of the tubing string with its reaming dogs expanded to the reaming positions thereof. While being run through the tubing with its reaming dogs collapsed or retracted it can pass through narrow restrictions such as are defined by ball valve profiles. In the fully expanded or open position the tool is enabled to ream out the largest dimensions, such as are defined by the completion profiles of the completion string.

For reaming or scraping activities hydraulic pressure is introduced into the chamber 44 such as by means of a pump or other suitable pressure source at the surface. For hydraulic pressure control normal workover fluids can be used, thus eliminating the need for expensive and hazardous chemicals such as acid which are conventionally used for this purpose and also eliminating the complications of disposing of hazardous chemical returns. The desired reaming size of any reaming operation can be adjusted simply by controlling the pump pressure being supplied to the tool by the surface pump. The pump induced hydraulic pressure develops a pressure differential across the restriction defined by either the flow passage 78 or the choke bean 86 thus permitting hydraulic pressure within chamber 44 to develop a pressure induced resultant force acting downwardly on the actuator mandrel 34. This downwardly directed force causes the cams 110 and 112 of the actuator mandrel to impart expansion force to the reaming dogs 96, 98 and 100 thus moving the reaming dogs radially outwardly. By controlling the pressure that is introduced into the chamber 104 the reaming dogs may be caused to engage the internal deposits within the tubing or the internal wall surface of the tubing itself so as to remove deposits from within the tubing or to actually enlarge the tubing by reaming so that the tubing is properly drifted to optimum dimension for use in the downhole environment. For reaming the internal wall surface of the tubing or for drifting the tubing, the reaming dogs 96, 98 and 100 may have any suitable external profile that is desired. In fact, since the reamer dogs are replaceable a reamer tool with straight reamer profiles may be employed for reaming the entire length of the tubing so as to remove deposits or to conduct drifting operations. Subsequently, another reaming tool or a tool with replaced reaming dogs may be employed having the reaming dog profiles as shown in FIGS. 1 and 3 or other suitable reaming profiles for the specific purpose of reaming the internal completion profiles of the tubing to clean them of undesirable internal deposits.

For efficient reaming of the completion profiles in a manner insuring against damage thereto, the reamer tool may be passed through the tubing string while not being rotated and with a suitable fluid pressure being applied within the chamber 44 to thereby urge the actuator mandrel downwardly and thereby urge the reaming dogs radially outwardly. When a completion profile is reached the outwardly urged reaming dogs will move efficiently into the respective profile. At this point the operator will become aware that the reaming tool has established proper reaming position relative to the completion profile. At this point rotation may be imparted to the reaming tool so as to begin cleaning of the completion profile. As rotation is continued the pressure within the chamber 44 may be increased thereby urging the actuator mandrel 34 downwardly and the reamer dogs radially outwardly with sufficient force to accomplish efficient cleaning of the completion profile even under circumstances where the internal deposit material is quite hard. As the rotation is continued the fluid pressure within the chamber 44 may be increased to cause camming expansion of the reamer dogs to the fully expanded positions thereof as shown in FIG. 3. In this position virtually all of any internal deposits may be effectively removed from the completion profile without in any manner altering or otherwise damaging the profile configuration.

When the reaming operation has been completed retraction of the reamer dogs is accomplished simply by reducing the fluid pressure within the internal pressure chamber 44 of the tool. When this is done the retraction garter springs 102 and 104 will simultaneously move the respective reaming dogs toward the fully retracted position thereof as shown in FIG. 1. When the reaming dogs are fully retracted the tool may be moved upwardly or downwardly within the tubing string as is desired to locate it for further tubing cleaning or drifting activities or to remove it from the tubing string.

If for some reason the reaming dogs become locked in their expanded positions while in registry with a completion profile it may be necessary to conduct a fishing operation to enable retraction of the reaming dogs and retrieval of the reamer tool. This is accomplished by first imparting an upward force to the upper sub of the tool which is sufficient to shear the shear screws 50 and 52. When this is done the working string including the downhole motor, if any, can be withdrawn from the tubing, leaving the housing, lower sub and actuator mandrel in position within the tubing and with the fishing neck 40 exposed. Thereafter, a fishing string will be introduced through the tubing and will be operated to lock within the fishing neck. The fishing string or wireline fishing tool may then be manipulated so as to cause retraction of the reaming dogs to the position shown in FIG. 1. When this is done the fishing tool, with the reamer attached thereto may simply be withdrawn from the tubing string.

Through use of the reaming tool of this invention and by selecting appropriate interchangeable reaming dogs, a number of differing reaming operations can be performed. The nipple profiles of the tubing string may be reamed to the original manufacturers' specifications. The tubing inside diameters may be reamed to A.P.I. drift specifications. Tight spots in the tubing may be reduced or eliminated. The housing edges of through tubing perforations may be polished. Also, internal tubing cuts may be made in the tubing by means of cutting dogs of the tool.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A method for removing internal deposits and/or drifting the production tubing string of a well which defines at least one internal completion profile, said method comprising:

(a) extending through said tubing string a reaming tool having radially movable reaming dogs at least some of which defining external reaming teeth having an external profile of mating configuration with said internal completion profile;

(b) moving said reaming tool within said tubing string to position said reaming dogs in registry with said internal completion profile;

(c) inducing radially outward movement of said expandable reaming dogs into said internal completion profile;

(d) rotating said reaming tool for removal of any foreign matter present within said internal completion profile;

(e) retracting said reaming dogs from said internal completion profile by radially inward movement thereof; and (f) repeating method steps (a) through (e) hereof for other internal completion profiles of said tubing string.

2. The method of claim 1, wherein said moving said profiled expandable reaming dogs into registry with said internal completion profile comprises:

(a) providing a mechanical actuator within said reaming tool which, upon linear movement thereof within said reaming tool in one direction, induces radially outward movement of said reaming dogs from the retracted positions thereof to the expanded positions thereof; and (b) inducing linear movement of said mechanical actuator in said one direction by controllably changing hydraulic pressure within said reaming tool.

3. The method of claim 2, wherein spring means within said reaming tool urges said reaming dogs radially inwardly toward the retracted positions thereof, said method including:

causing spring urged radially inward retracting movement of said expandable reaming dogs by reducing hydraulically induced pressure within said reaming tool.

4. The method of claim 1, wherein said reaming tool defines a flow passage therethrough having a restriction and defining a pressure responsive surface area, said method including:

pumping fluid through said restriction and developing a differential pressure induced resultant force acting on said pressure responsive area to impart radially outward movement to said reaming dogs toward the reaming positions thereof.

5. The method of claim 1, wherein said moving said reaming tool to position said reaming dogs in registry with said internal completion profile of said tubing string comprises:

(a) applying radially outward force to said reaming dogs with said reaming dogs out of registry with said internal completion profile so as to urge said expandable reaming dogs into forcible contact with the inner surface of said tubing string; and (b) moving said reaming tool linearly within said tubing string sufficiently to position said reaming dogs in registry with said internal completion profile thus permitting radially outward movement of said reaming dogs into said internal completion profile by said radially outward force.

6. The method of claim 5, including:

with said reaming dogs in registry with said completion profile, rotating said reaming tool while applying hydraulically induced expansion force to said reaming dogs, thus moving said reaming dogs radially toward fully engaged relation within said internal completion profile.

7. The method of claim 1, including:

conducting flow of fluid through said reaming tool and within said tubing string for accomplishing other fluid responsive activities below the depth of said reaming tool.

8. The method of claim 7, including:

conducting said flow of fluid through a restriction within said reaming tool for development of a pressure differential across said restriction, thus developing a pressure induced resultant force which causes application of radially outward force to each of said reaming dogs.

9. The method of claim 8, wherein an actuator is linearly movable within said reaming tool and is movable in one direction by said pressure induced resultant force, said actuator having cam means for radially outward camming actuation of said reaming dogs, said method including:

moving said actuator in one linear direction within said reaming tool for causing radially outward movement of said reaming dogs toward the reaming positions thereof.

10. The method of claim 1, wherein a linearly movable actuator cam is linearly movable within said reaming tool and defines cam surfaces, said expandable reaming dogs each defining cam surface means disposed for camming engagement by said linearly movable cam actuator for radially outward expansion movement of said expandable reaming dogs upon linear movement of said linearly movable cam in one direction, said method including:

imparting linear reaming dog movement to said linearly movable cam in said one direction by means of hydraulically induced resultant force for imparting radially outward force to said reaming dogs.

11. A well tubing reamer mechanism for removing foreign matter from the internal wall surfaces and internal completion profiles of the production tubing of wells and for drifting the well tubing while the well tubing is located within a well, comprising:

(a) a housing having an internal chamber and defining a plurality of lateral openings, said housing being adapted for rotationally driven connection to a work device defining a flow passage in communication with a source of fluid pressure;

(b) a plurality of reaming dogs being movably disposed within said internal chamber, each of said reaming dogs having a reaming portion thereof exposed at one of said lateral openings for radially outward expansion movement thereof through said lateral opening and toward the inner surface of said tubing string, said reaming dogs each being laterally movable from a retracted non-reaming position within said housing to a radially expanded reaming position for reaming said tubing string for removal of deposits of foreign matter therein and for drifting said tubing string, said reaming dogs each define a reamer profile adapted for mating relation with said internal completion profile;

(c) pressure responsive actuator means being disposed for linear movement within said internal chamber and partitioning said internal chamber into a pressure chamber and a reamer chamber, said reamer chamber containing said plurality of reaming dogs, upon being moved in one linear direction responsive to increase of fluid pressure within said pressure chamber said pressure responsive actuator imparting radially outward expansion movement to said reaming dogs toward said radially expanded reaming positions thereof; and (d) retractor means being located within said housing and being disposed in urging engagement with said plurality of reaming dogs, upon reduction of fluid pressure within said pressure chamber to a predetermined pressure level said retractor means imparting linear movement to said pressure responsive actuator in a direction opposite said one direction and imparting radially inward retracting movement to said reaming dogs toward said retracted non-reaming positions thereof.

12. The well tubing reamer mechanism of claim 11, wherein:

at said radially expanded reaming positions of said reaming dogs said reaming dogs being adapted to remove substantially all accumulation of foreign matter from said completion profile without distorting the configuration of said internal completion profile.

13. The well tubing reamer mechanism of claim 11, wherein:

said reaming dogs each define an external reaming profile for removal of accumulated foreign matter from the inner surface of said well tubing and for drifting said well tubing.

14. The well tubing reamer mechanism of claim 11, wherein said pressure responsive actuator comprises:

(a) an elongate actuator element being linearly movable within said housing and being sealed with respect to said housing, said elongate actuator element defining at least one external cam and defining a pressure responsive surface;

(b) said reaming dogs each define at least one cam surface disposed in reactive engagement with said external cam; and (c) upon application of fluid pressure to said pressure responsive surface said fluid pressure developing a resultant force acting to move said elongate actuator element in said one linear direction causing said cam to react against said cam surface of each of said reaming dogs and impart radially outward movement to said reaming dogs toward said expanded reaming positions thereof.

15. The well tubing reamer mechanism of claim 11, wherein:

said elongate actuator element defines a flow passage through which fluid is enabled to flow.

16. The well tubing reamer mechanism of claim 15, wherein:

said elongate actuator element defines an internal restriction for flow of fluid through said flow passage, upon application of fluid pressure to said pressure responsive surface a pressure differential being established across said restriction and a pressure induced resultant force being developed on said elongate actuator in a direction applying radially outward expansion force to said reaming dogs toward the reaming positions thereof.

17. The well tubing reamer mechanism of claim 11, including:

means continuously urging said reaming dogs radially inwardly toward said retracted non-reaming positions thereof.

18. The well tubing reamer mechanism of claim 11, wherein:

(a) said housing defines an upper sub and an intermediate housing section being nonrotatably interconnected, said upper sub having connection means for establishing said rotationally driven connection to said work device; and (b) shear means interconnecting said upper sub and said intermediate housing section and enabling forcible separation of said upper sub from said intermediate housing section upon application of predetermined upward force to said upper sub.

19. The well tubing reamer mechanism of claim 18, wherein:

said elongate actuator element defines a fishing neck at the upper end thereof which is exposed for downhole fishing activities when said upper sub is separated from said intermediate housing section.

* * * * *